US005261368A

United States Patent [19]

Umemoto

[11] Patent Number: 5,261,368

[45] Date of Patent: Nov. 16, 1993

[54] APPARATUS AND METHOD FOR CONTROLLING AN INTERNAL COMBUSTION ENGINE

[75] Inventor: Hideki Umemoto, Himeji, Japan

[73] Assignee: Mitsubishi Denki Kabushiki Kaisha, Tokyo, Japan

[21] Appl. No.: 959,413

[22] Filed: Oct. 13, 1992

[30] Foreign Application Priority Data

Oct. 16, 1991 [JP] Japan ..... 3-267654

[51] Int. Cl.[5] ..... F02D 7/06; F02M 3/00; F02B 23/00

[52] U.S. Cl. ..... 123/327; 123/339; 123/585

[58] Field of Search ..... 123/327, 325, 339, 585

[56] References Cited

U.S. PATENT DOCUMENTS

| | | | |
|---|---|---|---|
| 4,526,144 | 7/1985 | Hasegawa et al. | 123/339 |
| 4,649,877 | 3/1987 | Yasuoka et al. | 123/339 |
| 4,700,674 | 10/1987 | Iwata | 123/327 |
| 4,700,679 | 10/1987 | Otobe et al. | 123/327 |
| 4,709,674 | 12/1987 | Bianchi et al. | 123/339 |
| 4,799,466 | 1/1989 | Shibata et al. | 123/327 |
| 4,870,933 | 10/1989 | Mizuno | 123/325 |
| 4,938,199 | 7/1990 | Sato et al. | 123/327 |
| 4,989,563 | 2/1991 | Fukutomi et al. | 123/327 |
| 5,040,506 | 8/1991 | Yamane | 123/327 |

FOREIGN PATENT DOCUMENTS 151135 11/1980 Japan ..... 123/327

*Primary Examiner*—Raymond A. Nelli

*Attorney, Agent, or Firm*—Sughrue, Mion, Zinn, Macpeak and Seas

[57] ABSTRACT

An engine control apparatus and method can prevent engine stall in a reliable manner when the engine is changed from a high-speed loaded operation into an idling operation. An air/fuel mixture is supplied to engine cylinders 16 through an intake passage 1 with a throttle valve 6 disposed therein, and a bypass passage 10 with an air valve 12 disposed therein is connected with the intake passage 1 for bypassing the throttle valve 6 to supply auxiliary air to the cylinders. Based on an operating condition signal D in the form of an idle switch on/off signal, an electronic control unit (ECU) 30A detects a change from a loaded operation into an idling operation of the engine, and determines, based on a speed signal R from a speed sensor, whether the number of revolutions per minute of the engine R is equal to or less than a predetermined reference value Rk. The ECU 30A gradually closes the air valve 12 in the bypass passage 10 to decrease an amount of auxiliary air Ac flowing therein in a delayed manner when the engine is changed from a loaded operation into an idling operation, i.e., when the number of revolutions per minute of the engine becomes equal to or less than the predetermined reference value Rk.

3 Claims, 4 Drawing Sheets

APPARATUS AND METHOD FOR CONTROLLING AN INTERNAL COMBUSTION ENGINE

This invention relates to an apparatus and method for controlling an internal combustion engine so as to gradually decrease an amount of intake air or mixture supplied to the engine in a dashpot or delayed manner when the engine is transferred or changed from a high-speed loaded operation into an idling operation, and more particularly, it relates to such an apparatus and method which serve to prevent engine stall in a reliable manner upon such a change in engine operation.

Conventionally, in an engine control apparatus as used with an automotive engine, for the purpose of holding the rotational speed or number of revolutions per minute of the engine at a predetermined low value during engine idling, a bypass passage with an air valve therein is connected with an intake passage or manifold for bypassing a throttle valve therein, so that the air valve is controlled by an actuator such as a duty solenoid, a linear solenoid or the like in a closed loop manner to thereby adjust an amount of auxiliary air flowing in the bypass passage for fine adjustment of a total amount of intake air or mixture supplied to cylinders of the engine.

In this type of engine control apparatus, the amount of auxiliary air flowing through the bypass passage is gradually changed in order to enable the engine to smoothly transfer from an idling operation into a high-speed loaded operation or vice versa. In particular, if the air valve is swiftly closed concurrently with the closing of the throttle valve in the intake passage at the time when the engine is transferred from the high-speed loaded operation into the idling operation, the rotational speed or rpm of the engine abruptly decreases, causing a probability of engine stall. To avoid this, a dashpot or damping function is utilized to gradually decrease the amount of auxiliary air flowing in the bypass passage at such situations.

FIG. 4 schematically illustrates the general construction of an internal combustion engine equipped with a known engine control apparatus having such a dashpot function. In this Figure, the engine includes an intake passage or manifold 1 which is connected at one end thereof with an air cleaner 2 and at the other end thereof with a plurality of engine cylinders 16, though only one cylinder 16 is exemplarily illustrated. An air-flow meter 4 is disposed in the air intake passage 1 at a location downstream of the air cleaner 2 for metering an amount of intake air A flowing in the intake passage 1. A throttle valve 6 is disposed in the intake passage 1 at a location intermediate the ends thereof downstream of the air-flow meter 4 for controlling the amount of flow rate of intake air supplied to the cylinders 16 through the intake passage 1. A surge tank 8 having a cross sectional area greater than that of the intake passage 1 is inserted in and connected with the intake passage 1 downstream of the throttle valve 6. A bypass passage or duct 10 is connected at one end thereof with the intake passage 1 at a location between the air-flow meter 4 and the throttle valve 6 and at the other end with the surge tank 8 for bypassing the throttle valve 6. An air valve 12 is disposed in the bypass passage 10 intermediate the ends thereof for adjusting an amount of auxiliary air passing through the bypass passage 10. For example, the air valve 12 comprises an electromagnetic duty solenoid for controlling a duty ratio, i.e., a conduction time ratio between an open period and a closure period of the solenoid valve 12, the valve 12 being controlled through a time ratio between a conduction period and a non-conduction period of a current having a constant magnitude supplied to the solenoid to adjust the amount of flow rate of auxiliary air Ac flowing through the bypass passage 10. In this regard, instead of controlling the conduction time ratio of the solenoid, the magnitude of the current supplied to the solenoid valve 12 can be controlled for the same purpose.

The illustrated known apparatus further includes a fuel injection valve 14 disposed in the intake passage 1 downstream of the surge tank 8, a spark plug 18 mounted on a cylinder head of each cylinder 16 with its electrodes present in a combustion chamber defined in each cylinder 16, a catalytic converter 19 disposed in an exhaust passage or manifold 17 near an outlet end thereof for treating or purifying exhaust gases discharged from the cylinders 16, a speed sensor 20 operatively connected with an unillustrated crankshaft of the engine for sensing the rotational speed or the number of revolutions per minute R of the engine, and sensor means 22 including a variety of sensors for sensing various operating conditions of the engine.

An electronic control unit (ECU) 30 receives an output signal A from the air-flow meter 4 representative of the flow rate of intake air flowing in the intake passage 1, an output signal R from the speed sensor 20 representative of the rotational speed or number of revolutions per minute of the engine, and an operating condition signal D from the sensor means 22, and generates, based on these input signals, control signals C12, C14 and C18 for controlling the air valve 12 in the bypass passage 10, the fuel injection valve 14, and the spark plug 18 for each cylinder 16, respectively. Specifically, the ECU 30 includes an auxiliary air adjusting means for adjusting the amount of auxiliary air Ac flowing through the bypass passage 10 on the basis of the control signal C12 in such a manner that in a loaded operation of the engine, the air valve 12 is fully opened to increase the amount or flow rate of auxiliary air flowing through the bypass passage 10, whereas in an idling operation, it is controlled based on a comparison between the current rotational speed of the engine and a predetermined idling speed to thereby properly adjust the flow rate of auxiliary air in the bypass passage 10.

The ECU 30 also includes an idling detecting means for detecting, based on the operating condition signal D from the sensor means 22, a change in engine operation when the engine is transferred or switched from a loaded operation into an idling operation, and for reducing the rotational speed of the engine upon detection of such a change. The auxiliary air adjusting means performs a dashpot or damping function of decreasing a closing speed of the air valve when the idling detecting means detects a change from a loaded operation into an idling operation, so that the flow rate of auxiliary air flowing through the bypass passage 10 is gradually reduced, thus stabilizing the engine rotation at a predetermined idling speed.

The operation of the known engine control apparatus will be described below while referring to FIG. 4. During normal operation of the engine, the engine operates in four cycles including an intake stroke, a compression stroke, a combustion stroke and an exhaust stroke in the following manner. Namely, in the intake stroke, air is sucked into the intake passage 1 via the air cleaner 2, mixed with an appropriate amount of fuel injected from the fuel injection valve 14, and supplied therefrom to the combustion chamber of each cylinder 16. Subsequently, in the combustion stroke, a mixture of air and fuel thus supplied to the combustion chamber in each cylinder 16 is fired by the spark plug 18 to generate an output torque whereby the unillustrated crankshaft of the engine is driven to rotate. Exhaust gases generated by combustion of the air/fuel mixture are discharged from the combustion chambers into the ambient atmosphere through the exhaust pipe or manifold 17 while being treated or purified by the catalytic converter 19.

The opening of the throttle valve 6 during engine operation corresponds to an amount of depression of an unillustrated accelerator pedal operatively connected to the throttle valve 6, and in the loaded operation of the engine, the driver steps down on the accelerator pedal to thereby place the throttle valve 6 to a fully opened position. As a result, the amount of intake air A sucked into the cylinders 16 is maximized. During the loaded operation, the ECU 30 generates a control signal C12 whereby the air valve 12 in the bypass passage 10 is also fully opened.

The ECU 30 properly controls the fuel injection valve 14 and the spark plug 18 in response to the output signal A from the air-flow meter 4 representative of the amount or flow rate of intake air, the output signal R of the speed sensor 20 representative of the rotational speed or rpm of the engine, and the operating condition signal D from the sensor means 22 representative of an engine operating condition such as the opening of the throttle valve 6, and/or in synchronization with control timing for the cylinders 16, so that the engine can generate optimal output torque or power.

Next, the operation of the known apparatus will be described below in the case when the engine operation is transferred or changed from a loaded operation or a racing operation (i.e., acceleration under no load) into an idling operation in which the throttle valve 6 is fully closed. FIG. 5 is a flow chart showing the operation of the ECU 30 upon such a change in the engine operation.

As shown in FIG. 5, in Step S1, the ECU 30 determines, based upon an operating condition signal D representative of the throttle opening or the "ON" or "OFF" state of an unillustrated idle switch, whether the engine is changed into an idling operation. In this connection, when the throttle valve 6 is fully closed, the idle switch is on, and at other times, it is off. Thus, if the idle switch is off (i.e., the engine is not idling), then in Step S2, it is recognized that the engine is in a loaded operation, and hence the ECU 30 controls to open the air valve 12, thus increasing the amount of flow rate of auxiliary air flowing in the bypass passage 10 to a maximum value.

If, however, the idle switch is turned on (i.e., the throttle valve 6 is fully closed), then in Step S3, it is recognized that the engine is changed into idling, and the ECU 30 performs, immediately after such a change, a dashpot or damping function of gradually or slowly closing the air valve 12 in order to decelerate the engine. As a result, the amount or flow rate of auxiliary air Ac in the bypass passage 10 is gradually decreased.

In this connection, it is to be noted that when the throttle valve 6 is fully closed during a high-speed operation of the engine, the amount or flow rate of auxiliary air Ac decreases concurrently with the idle switch being turned on, even though the dashpot function is utilized, as a consequence of which the rotational speed or rpm R of the engine suddenly decreases below a prescribed idling speed or rpm Ri, and then restores to that idling speed, as shown by the broken line in FIG. 3.

This overshoot phenomenon is not desired from the standpoint of idle speed control, and may impair a driving sensation or comfort of the driver. Furthermore, when the engine rotational speed R is excessively or greatly decreased to zero during deceleration control, the probability of engine stall becomes greater.

Thus, with the known engine control apparatus and method as described above, the amount of flow rate of auxiliary air Ac is decreased immediately when it is determined, based on the full closure of the throttle valve 6, that the engine has been changed into an idling operation. As a result, if the engine rotational speed R at the time of the engine being changed into idling is very high, a sufficient amount of auxiliary air Ac will not be supplied to the cylinders 16, and thus the engine rotational speed R will be abnormally reduced, giving rise to a fear of engine stall.

SUMMARY OF THE INVENTION

Accordingly, the present invention is intended to overcome the above-mentioned problems encountered with the known engine control apparatus and method.

An object of the invention is to provide a novel and improved engine control apparatus and method which are able to prevent engine stall in a reliable manner when the engine is changed from a high-speed loaded operation into an idling operation.

In order to achieve the above object, according to one aspect of the present invention, there is provided an engine control apparatus comprising: primary supply means for supplying an air/fuel mixture to cylinders of an internal combustion engine; auxiliary supply means for supplying auxiliary air to the cylinders; a speed sensor for sensing the number of revolutions per minute of the engine and generating a corresponding output signal; sensor means for sensing operating conditions of the engine and generating a corresponding output signal; and control means connected to receive the output signals from the speed sensor and the sensor means for controlling, based thereon, the primary and auxiliary supply means in such a manner that an amount of air/fuel mixture and an amount of auxiliary air supplied to the cylinders are controlled in accordance with the engine operating conditions. The control means comprises: idling detecting means connected to receive the output signal from the sensor means for detecting, based thereon, a change from a loaded operation into an idling operation of the engine; rotational speed determining means connected to receive the output signal from the speed sensor for determining, based thereon, whether the number of revolutions per minute of the engine is not greater than a predetermined reference value; and auxiliary air adjusting means associated with the idling detecting means and the rotational speed determining means for gradually decreasing an amount of auxiliary air supplied to the cylinders when the engine is changed from a loaded operation into an idling operation and when the number of revolutions per minute of the engine becomes equal to or less than the predetermined reference value.

According to another aspect of the invention, there is provided a method for controlling an internal combustion engine in which an air/fuel mixture is supplied to cylinders of the engine through primary supply means and in which auxiliary air is supplied to the cylinders through auxiliary supply means, the method comprising the steps of: detecting when the engine is changed from a loaded operation into an idling operation; determining whether the number of revolutions per minute of the engine is equal to or less than a predetermined reference value; and gradually decreasing an amount of auxiliary air supplied to the cylinders when the engine is changed from a loaded operation into an idling operation and when the number of revolutions per minute of the engine is equal to or less than the predetermined reference value.

The above and other objects, features and advantages of the invention will be more readily apparent from the following detailed description of a preferred embodiment of the invention taken in conjunction with the accompanying drawings.

DESCRIPTION OF THE PREFERRED EMBODIMENTS

A preferred embodiment of the present invention will now be described in detail while referring to the accompanying drawings.

An engine control apparatus according to the present invention includes a primary supply means for supplying an air/fuel mixture to a plurality of cylinders of an internal combustion engine; an auxiliary supply means for supplying auxiliary air to the cylinders; a speed sensor for sensing the rotational speed or number of revolutions per minute of the engine and generating a corresponding output signal; sensor means for sensing operating conditions of the engine and generating a corresponding output signal; and a control means connected to receive the output signals from the speed sensor and the sensor means for controlling, based thereon, the primary and auxiliary supply means in such a manner that an amount of air/fuel mixture and an amount of auxiliary air supplied to the cylinders are controlled in accordance with the engine operating conditions.

Figure 4:
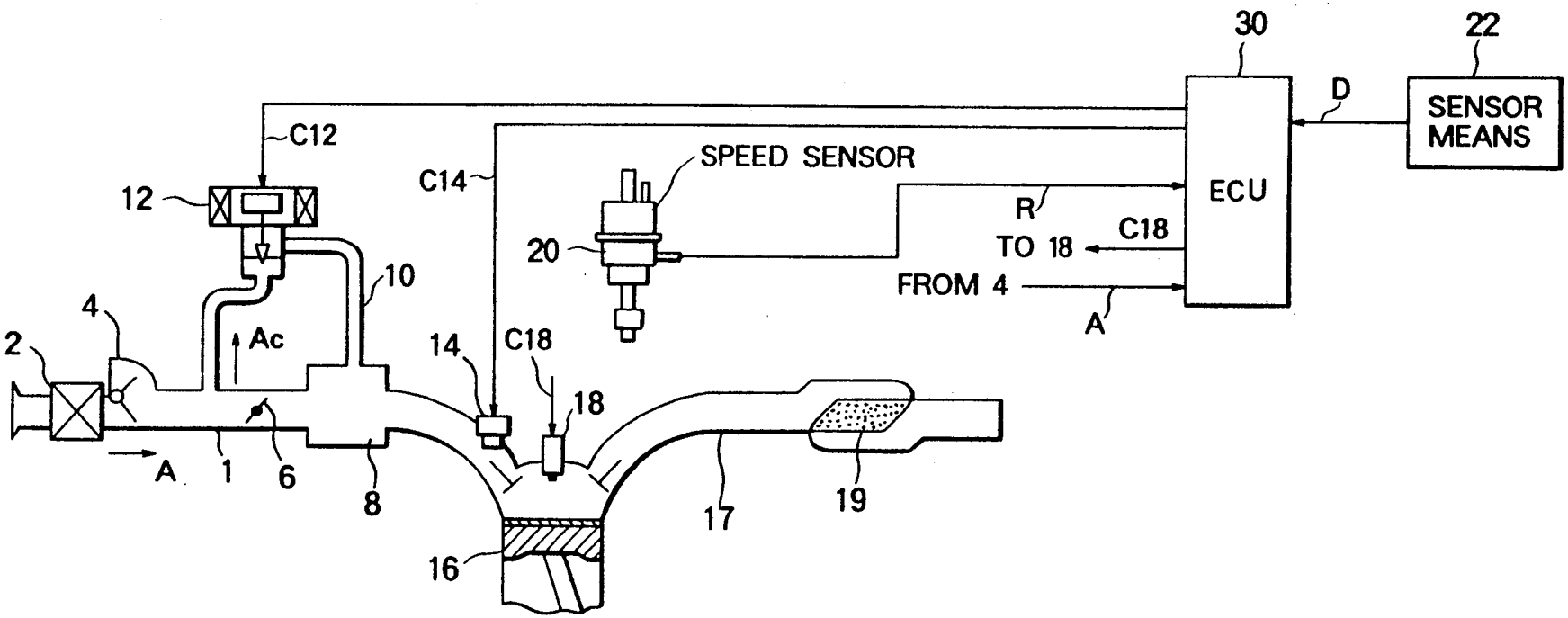
FIG. 4 is a schematic view showing the general construction of a known engine control apparatus.
Figure 5:
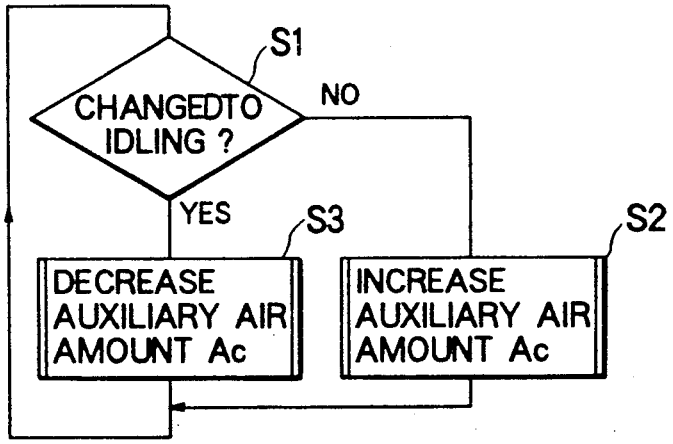
FIG. 5 is a flow chart showing a known engine control method carried out by the apparatus of FIG. 4.

As shown in the previously mentioned FIG. 4, the primary supply means comprises an intake passage 1 with a throttle valve 6 and a fuel injection valve 14 disposed therein for supplying an air/fuel mixture to the cylinders 16.

As similarly shown in FIG. 4, the auxiliary supply means comprises a bypass passage 10 connected with the intake passage 1 for bypassing the throttle valve 6, and an air valve 12 which is disposed in the bypass passage 10 and operated by the control means for controlling auxiliary air flowing in the bypass passage 10.

The above-described construction and operation of the engine control apparatus are substantially similar to those of the aforementioned known engine control apparatus as illustrated in FIG. 4 except for the construction of the control means and the operation of the air valve 12.

Figure 1:
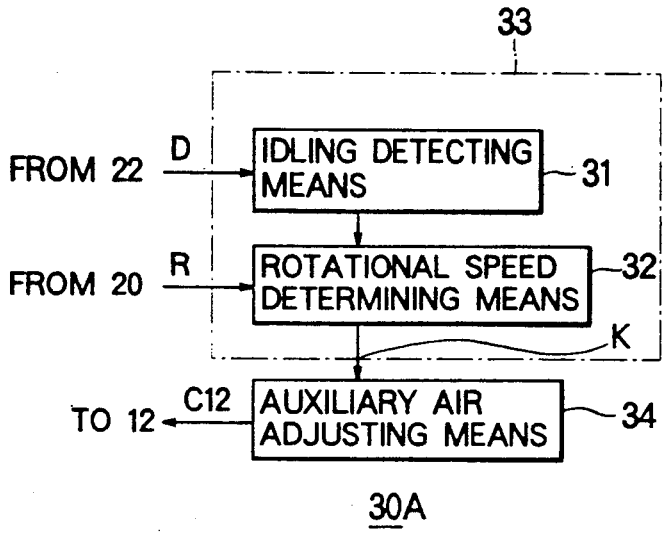
FIG. 1 is a block diagram of an electronic control unit constituting an essential portion of an engine control apparatus according to the present invention.

Specifically, as shown in FIG. 1, the control means takes the form of an electronic control means 30A which comprises: an idling detecting means 31 connected to receive an output signal D from the sensor means 22 representative of an engine operating condition for detecting, based thereon, a change from a loaded operation into an idling operation of the engine; a rotational speed determining means 32 connected to receive an output signal R from the speed sensor 20 representative of the rotational speed or number of revolutions per minute of the engine for determining, based thereon, whether the number of revolutions per minute of the engine R is equal to or less than a predetermined reference value Rk; and an auxiliary air adjusting means 34 for adjusting the air valve 12 in the bypass passage 10 to thereby control auxiliary air therein. The idling detecting mean 31 and the rotational speed determining means 32 together constitute a deceleration determining means 33. Based on an output signal K from the deceleration determining means 33 and hence the rotational speed determining means 32, the auxiliary air adjusting means 34 generates a control signal C12 to the air valve 12 in such a manner that the air valve 12 is gradually closed to decrease an amount of auxiliary air in the bypass passage 10 when the engine is changed from a loaded operation into an idling operation and when the number of revolutions per minute of the engine R is equal to or less than the predetermined reference value Rk.

Figure 2:
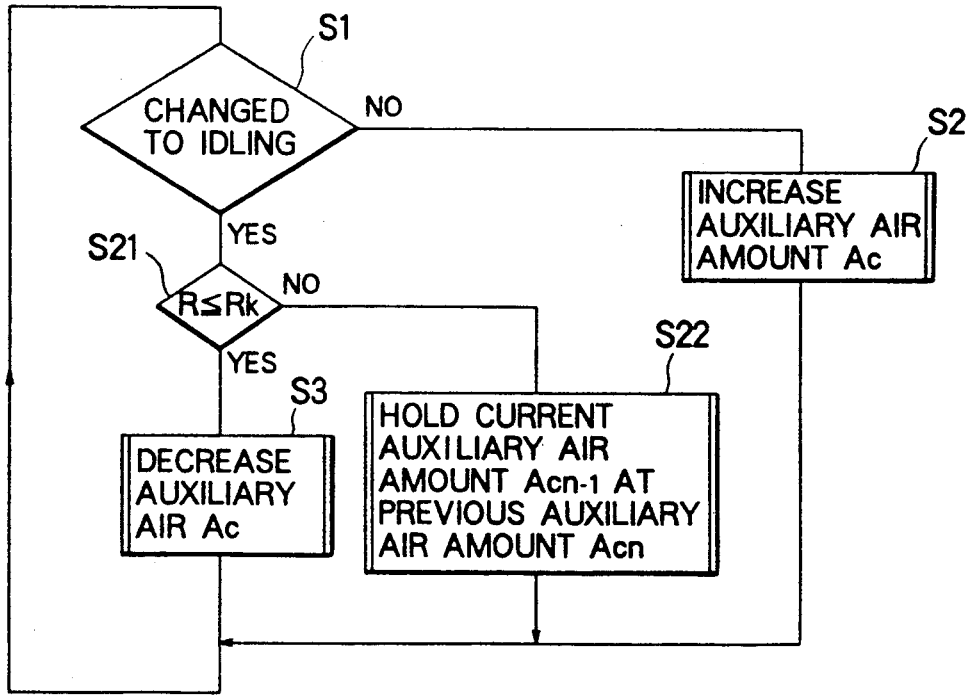
FIG. 2 is a flow chart showing an engine control method according to the present invention.
Figure 3:
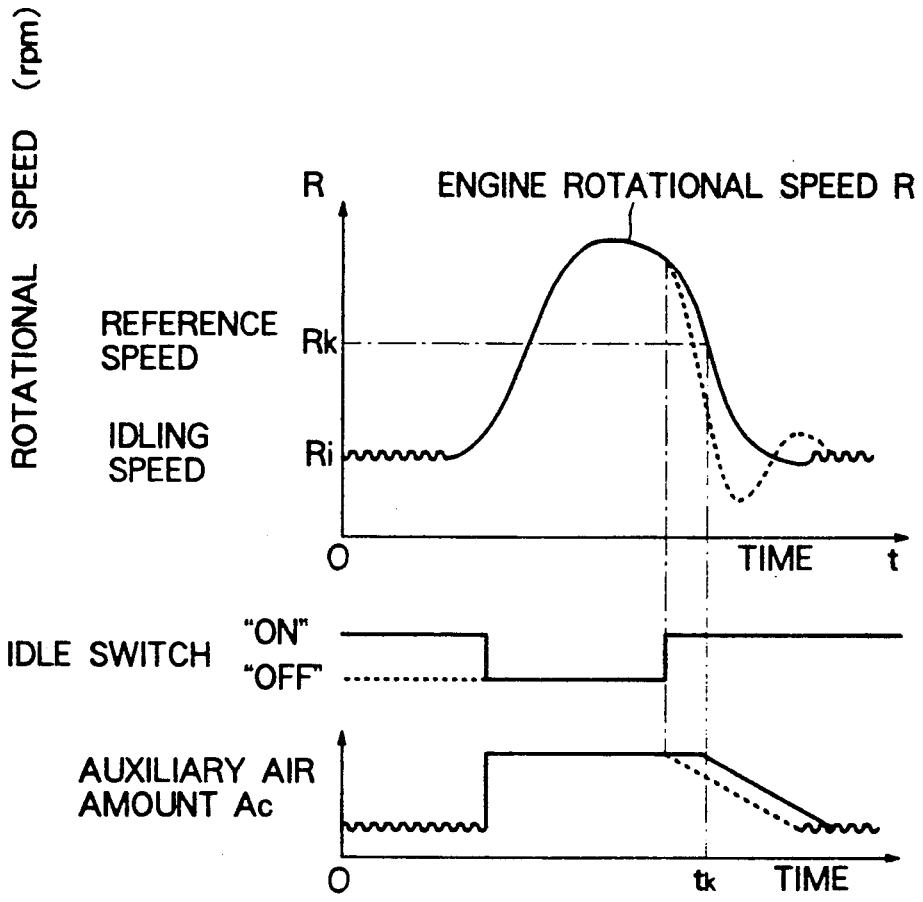
FIG. 3 is a waveform diagram showing the rotational speed of an engine varying over time in accordance with the invention.

Now, the operation of the above-described engine control apparatus or an engine control method according to the present invention will be described in detail with particular reference to the flow chart of FIG. 2, the waveform diagram of FIG. 3 and the general arrangement of FIG. 4.

First, in Step S1, based on the operating condition signal D in the form of an idle switch signal indicative of an "ON" or "OFF" state of an unillustrated idle switch, the idling detecting means 31 determines whether the engine is changed from a loaded operation into an idling operation. If the idle switch signal D shows the "OFF" state indicative of the throttle valve 6 being in a fully open state, the answer to this question becomes negative. In this case, it is recognized in Step S2 that the engine is in a loaded operation, and the auxiliary air adjusting means 34 generates a control signal C12 to the air valve 12 in the bypass passage 10 whereby the air valve 12 is moved to or held at its fully open position, thus increasing an amount of auxiliary air Ac to a maximum. If, however, the answer in Step S1 is positive (i.e., the idle switch is on), then the control process goes to Step S21 where, based on the rotational speed signal R, the rotational speed determining means 32 determines whether the rotational speed or number of revolutions per minute of the engine R is not greater than the predetermined reference value Rk. If not (i.e., $R > Rk$), the control process goes to Step S22 where a current amount of auxiliary air Acn is held at a previous amount of auxiliary air Acn-1 which was previously set. That is, in this case, the air valve 12 is also moved to or held at its fully open position so as to maximize the amount of auxiliary air Ac as in the case of the idle switch being off. As a result, it is ensured that a sufficient amount of auxiliary air Ac can be continuously supplied to the cylinders 16, thus avoiding a sudden reduction in the engine rotational speed R and hence resultant engine stall. In this case, however, since the idle switch is on and the throttle valve 6 is fully closed, the rotational speed R of the engine decreases as shown by a solid line in FIG. 3.

On the other hand, in Step S21, as the engine rotational speed R decreases with the passage of time t, the rotational speed determining means 32 at last determines that the engine rotational speed R has become equal to or less than the predetermined reference value Rk, whereupon it generates a corresponding output signal K to the auxiliary air adjusting means 34. From the point of start tk of the output signal K, the auxiliary air adjusting means 34 starts to generate a control signal C12 for closing the air valve 12 in the bypass passage 10, as a consequence of which the amount of auxiliary air Ac flowing in the bypass passage 10 is gradually decreased, thus reducing the engine rotational speed R to a predetermined idling speed Ri in a gradual and delayed manner. Accordingly, the rotational speed R can gradually decrease to the idling speed Ri in a very smooth and stable manner without experiencing any abrupt and excessive fall, or "overshoot", as shown by a broken line in FIG. 3. Once the predetermined idling speed Ri has been reached, normal or usual idling control is performed so that the air valve 12 is finely adjusted by a control signal C12 from the ECU 30A to hold the engine rotational speed R at around the predetermined idling speed Ri. From Steps S2, S3 and S22, the control process returns to Step S1, and all the above Steps are repeated.

Although in the above description, the idling detecting means 31 determines a change from a loaded operation into an idling operation on the basis of an idle switch on/off signal, such a determination can be made based on the opening of the throttle valve 6 which can be sensed by a throttle sensor.

What is claimed is:

1. An apparatus for controlling an internal combustion engine, comprising:

primary supply means (1,2,6) for supplying an air/fuel mixture to cylinders of an internal combustion engine;

auxiliary supply means (10,12) for supplying auxiliary air to said cylinders;

a speed sensor (20) for sensing the number of revolutions per minute of said engine and generating a corresponding output signal (R);

sensor means (22) for sensing operating conditions of said engine and generating a corresponding output signal (D); and control means (30A) connected to receive the output signals from said speed sensor and said sensor means for controlling, based thereon, said primary and auxiliary supply means in such a manner that an amount of air/fuel mixture and an amount of auxiliary air supplied to said cylinders are controlled in accordance with the engine operating conditions;

said control means comprising:

idling command detecting means (31) connected to receive the output signal from said sensor means for detecting, based thereon, a commanded change from a loaded operation into an idling operation of said engine;

rotational speed determining means (32) connected to receive the output signal from said speed sensor for determining, based thereon, whether the number of revolutions per minute of said engine is not greater than a predetermined reference value (Rk); and auxiliary air adjusting means (34) associated with said idling command detecting means and said rotational speed determining means for gradually and linearly decreasing an amount of auxiliary air supplied to said cylinders only when both said engine is commanded to change from a loaded operation into an idling operation, and the number of revolutions per minute of said engine becomes equal to or less than said predetermined reference value, thereby delaying the commencement of the auxiliary air decrease to avoid idling speed overshoot.

2. An engine control apparatus according to claim 1 wherein said primary supply means comprises an intake passage with a throttle valve disposed therein for supplying an air/fuel mixture to said cylinders, and said auxiliary supply means comprises; a bypass passage connected to said intake passage for bypassing said throttle valve; and an air valve disposed in said bypass passage and being controlled by said auxiliary air adjusting means in such a manner that it is gradually closed when said engine is changed from a loaded operation into an idling operation and when the number of revolutions per minute of said engine is equal to or less than said predetermined reference value.

3. A method for controlling an internal combustion engine in which an air/fuel mixture is supplied to cylinders of said engine through primary supply means and in which auxiliary air is supplied to said cylinders through auxiliary supply means, said method comprising the steps of:

detecting when said engine is commanded to change from a loaded operation into an idling operation;

determining whether the number of revolutions per minute of said engine is equal to or less than a predetermined reference value; and gradually and linearly decreasing an amount of auxiliary air supplied to said cylinders only when both said engine is commanded to change from a loaded operation into an idling operation, and the number of revolutions per minute of said engine is equal to or less than said predetermined reference value, thereby delaying the commencement of the auxiliary air decrease to avoid idling speed overshoot.

* * * * *